United States Patent [19]

Newman et al.

[11] Patent Number: 4,892,342

[45] Date of Patent: Jan. 9, 1990

[54] VEHICLE DOOR HANDLE MOUNTING ARRANGEMENT

[75] Inventors: Howard G. Newman, Troy; David G. Monette, Warren; Michael D. Koczara, St. Clair Shores; Duane J. Ribant, Fraser; Ronald D. Papke, Rochester; Alfred A. Bien, West Bloomfield; Richard A. Hawkins, Livonia, all of Mich.

[73] Assignee: Chrysler Motors Corporation, Highland Park, Mich.

[21] Appl. No.: 296,636

[22] Filed: Jan. 13, 1989

[51] Int. Cl.[4] ..... E05C 21/00

[52] U.S. Cl. ..... 292/347; 292/336.3; 292/DIG. 53; 292/DIG. 64

[58] Field of Search ..... 292/247, 337, 347, 336.3, 292/DIG. 31, DIG. 53, DIG. 64, 113

[56] References Cited

U.S. PATENT DOCUMENTS

| | | | |
|---|---|---|---|
| 4,186,952 | 2/1980 | Glass | 292/DIG. 53 X |
| 4,381,656 | 5/1983 | Hayakawa | 292/DIG. 53 X |
| 4,693,503 | 9/1987 | Bisbing | 292/DIG. 53 X |

*Primary Examiner*—Richard E. Moore

*Attorney, Agent, or Firm*—Edward P. Barthel

[57] ABSTRACT

A vehicle door outside handle housing is mounted in a door panel rectangular opening such that the housing peripheral lip flange portion is in flush contact with the panel outboard surface with the housing main portion inserted in the panel opening. A central hub extends inboard from the housing main portion with its principal axis aligned on the geometric center of the opening. The hub is formed with an external thread for engagement by the internally threaded lead-in collar portion of a piloted nut. A bent spring rod retainer in its unrestrained state is assembled between the inboard surface of the panel and the undersurface of the nut driving head. The spring rod retainer includes a looped central eye formation defining a semi-circular eyelet that is self-aligned on the hub axis and telescopically receives the nut collar. Upon threaded engagement the piloted nut captures the retainer and the housing in the panel opening. As the nut is tightened the spring rod retainer is axially compressed between the panel inner surface and the nut undersurface to induce a preload locking the nut against loosening such as by vehicle induced vibrations and the like.

8 Claims, 3 Drawing Sheets

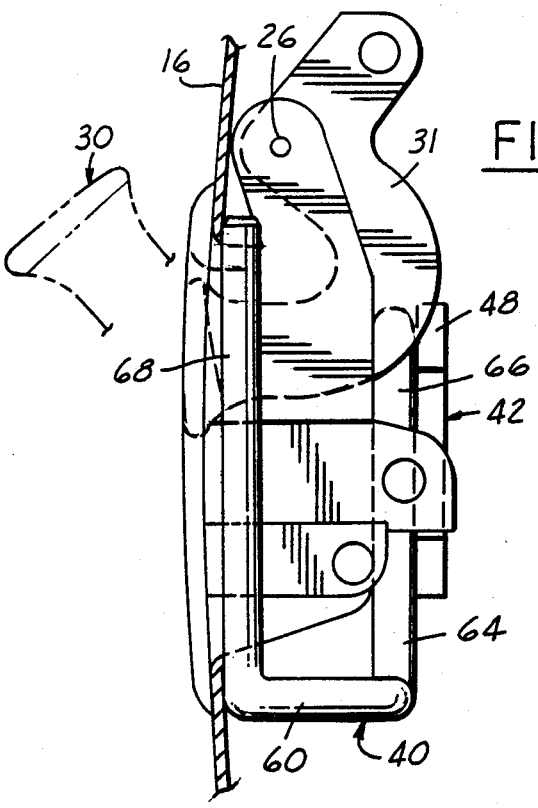
FIG.4
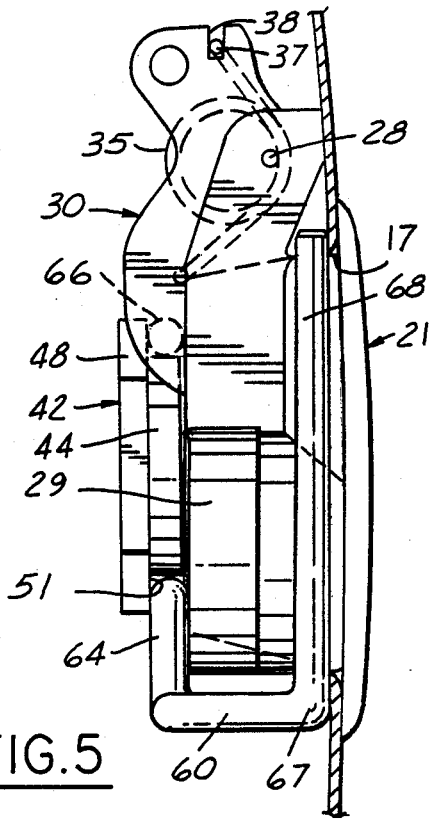
FIG.5
FIG.6
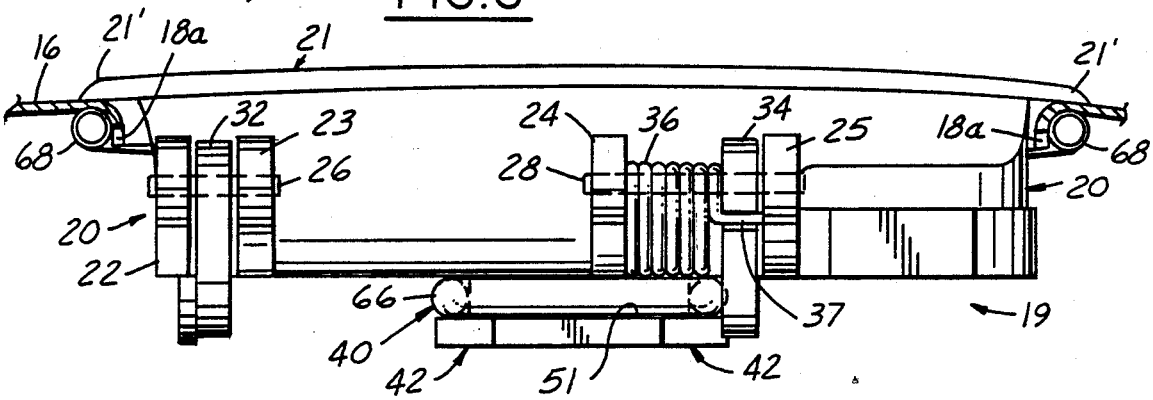
FIG.7
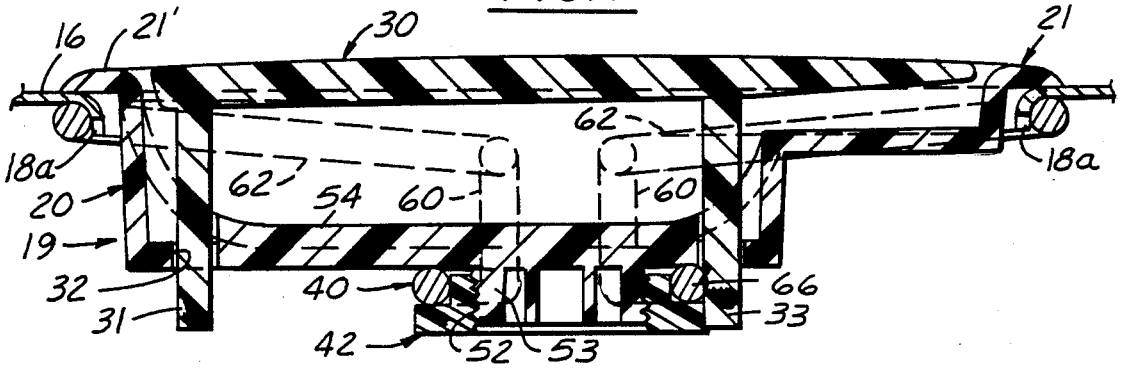

FIG.8
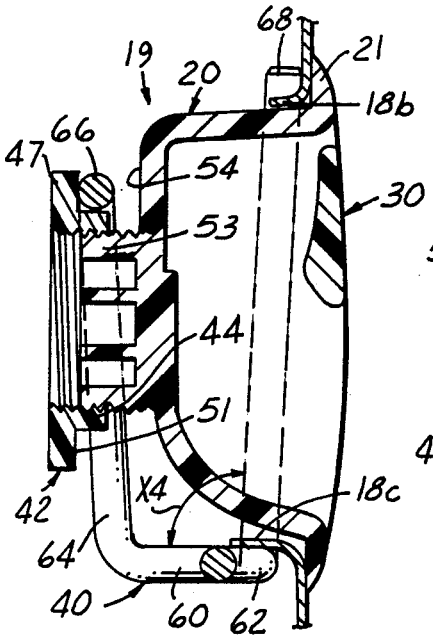
FIG.9
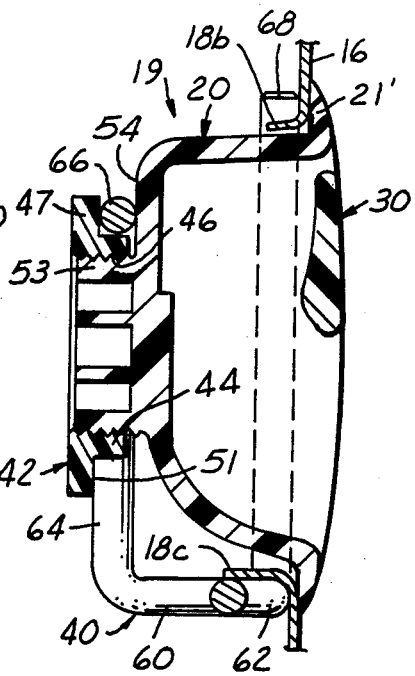
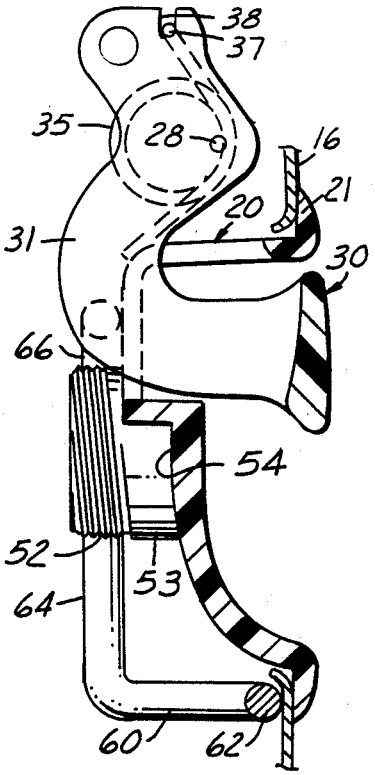
FIG.10
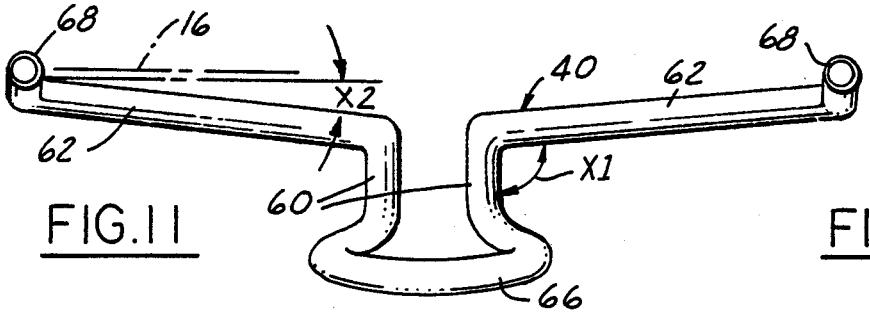
FIG.11
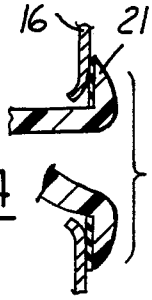
FIG.14
FIG.12
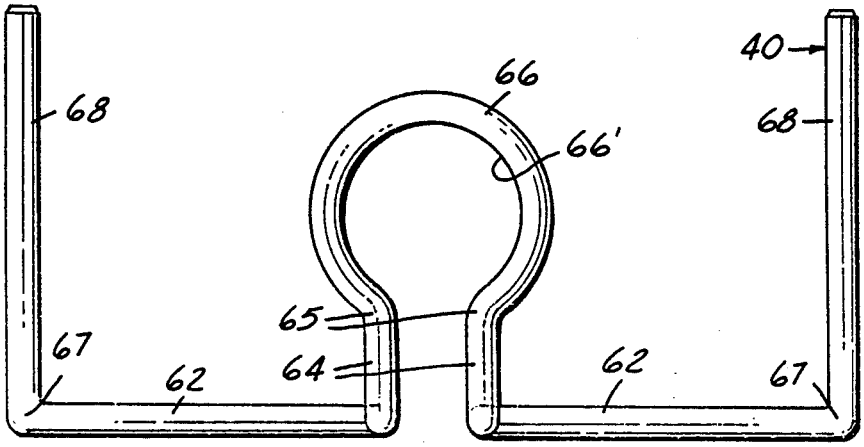
FIG.13
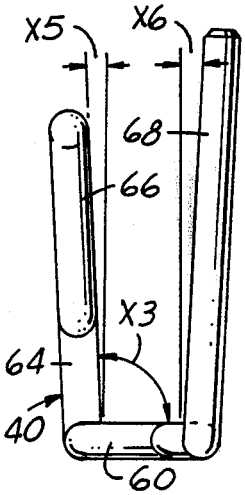

VEHICLE DOOR HANDLE MOUNTING ARRANGEMENT

BACKGROUND OF THE INVENTION

This invention relates generally to a vehicle door handle arrangement and more particularly to an improved arrangement for mounting a vehicle flush-type door handle assembly to an outside door panel for actuating a door latch mechanism.

One example of a prior art flush type outside door handle mounting arrangement presently used on Chrysler Motors Corporation vehicles is shown in the exploded perspective view of FIG. 1. The door handle mounting arrangement comprises a hande assembly generally indicated at "A", and a bracket "B". The handle assembly is adapted to support a lock cylinder assembly, partially indicated at "C", by telescopic reception within a hollow stem portion "D" formed in an elongated housing member "E" of the handle assembly. A vehicle door outer panel "F" has a rectangular-shaped opening "G" adapted to receive the handle assembly "A" with the panel opening defined by an inwardly directed continuous border flange "H". The elongated housing member "E" is formed with a forward crank arm "I" and an aft crank arm "J" supporting a pivot pin "K" therebetween. The handle housing is fixed to the door outside panel by means of two fasteners in the form of upper "L" and lower "M" inwardly extending threaded studs which are threaded into or staked to the handle housing member "E". The studs are adapted to pass through aligned holes "N" and "O" in the support bracket "B" and secured by nut "P". The bracket "B" has a pair of left and right laterally extending wing portions "Q—Q" each formed with foot portions "R—R". The foot portions are adapted to straddle and engage either side of an inwardly directed border flange "H" and the panel "F" in bearing contact upon tightening of the nuts "P". A main "pull-to" handle, shown in its outwardly rotated position by dashed lines "S", has a forward lever arm "T" and an aft lever arm "U" pivotally supported at each end of the pin "K". The handle "S" is rotated about the pin "K" against the biasing force of helical spring "V" coiled around the pin to actuate the door latch mechanism enabling the door to be opened.

The U.S. Pat. No. 2,997,324 issued Aug. 22, 1961 to D. R. Wolfslayer discloses a prior art lock mechanism mounted on a vehicle swinging door operated by a "pull-to" handle of the general type shown in FIG. 1. The U.S. Pat. No. 3,858,921 issued Jan. 7, 1975 to N. Kuki and U.S. Pat. No. 3,967,844 issued July 6, 1976 N. Torii et al. are further examples of outside "pull-to" vehicle outside door handle assemblies of the general type shown in FIG. 1. In all of the above mentioned patents multiple door panel attachment fasteners are required to secure the handle assemblies.

SUMMARY OF THE INVENTION

Accordingly, it is an object of the present invention to provide a novel and improved mounting arrangement to simply and reliably secure a housing in an opening of a vehicle panel that is economic to produce and requires a minimum of labor to install.

Another object of this invention is to provide a novel low cost mounting arrangement for securing and centering a housing in a rectangular opening of a vehicle panel by means of a bent spring rod retainer readily clamped in a prestressed manner by a single nut threadably engaging a housing central threaded hub portion aligned on the symmetrical axis of the opening thereby obviating loosening of the nut such as by vehicle induced vibration.

Still another object of the present invention is to provide a mounting arrangement for securing a vehicle door handle housing as set forth above wherein the biased spring rod retainer tends to hold a terminal lip flange portion of the housing in a sealed manner with the panel outer surface while providing a uniform distribution of pressure on the panel thereby insuring against surface bulges or dimples developing in the panel outer surface.

A vehicle door outside flush-type handle assembly has its housing mounted in an outer door panel rectangular opening in a self-centering manner. The housing comprises a peripheral lip flange portion, adapted for flush sealed contact with the panel outboard surface, and a main box-shaped portion extending inboard through the panel opening. The housing main portion is formed with an integral central hub portion extending inboard therefrom with its principal axis aligned on the geometric center of the opening.

A continuous bent rod spring retainer, formed transversely symmetrical from side to side, comprises a pair of mirror image generally L-shaped base portions lying in a horizontally disposed base plane. Each of the L-shaped base portions comprise integrally-connected short and long legs oriented at a first obtuse angle. The short legs extend inboard in a spaced manner from the proximate ends of their associated long legs. The inboard ends of the short legs are connected to an associated upstanding transition finger with each finger having its upper end joined to one open end of a central looped eye formation defining a semi-circular eyelet. The spring retainer eye formation and depending spaced fingers are disposed in a first common plane sloped inboard at an obtuse angle to the base plane. Each long leg has its distal end connected by a right-angle bend to an upstanding arm having a determined length approximately equal to the height of the rectangular-shaped panel opening. The spring retainer arms are disposed in a second common plane sloped outboard at an obtuse angle to the base plane.

The panel opening is formed with opposed inboard extending border side flange portions and inboard extending border lower flange portion. The spring rod retainer eye formation has the center of its eyelet self-aligned on the symmetrical axis of the panel rectangular opening. To accomplish such self-centering the installer merely locates the spring retainer arms juxtaposed on the outer surface of an associated one of the border side flange portions of the rectangular opening. The installer completes the retainer eyelet centering by moving the pair of L-shaped base portions into contact with the downwardly directed surface of the opening lower flange.

The housing main portion integral hub is aligned with the retainer eyelet so as to define a substantially concentric gap with the surrounding looped eye formation. The hub has an external thread thereon adapted to engage the internally threaded collar portion of a piloted nut. Upon the piloted nut collar being threaded-on the hub the nut's radially extending driving hex head undersurface bears on the looped eye formation which closely surrounds the collar portion.

The spring retainer is clamped between the nut hex head undersurface and the panel inner surface securing the housing in the panel opening by virtue of the retainer eye formation being captured by the nut head while its rod arm portions contact the inner surface of the panel. Upon the nut being turned in a threaded-on direction pressure is brought to bear on the spring retainer causing the rod arm portions and the long legs of the L-shaped base portions to be prestressed into substantially flush relation with the panel inboard surface. As a result rod length portions are in opposed substantially coextensive relation to associated housing side and bottom lip flange portions insuring uniform sealing pressure distribution on the panel portions sandwiched therebetween. The prestressed spring rod retainer maintains a constant axial biasing force resisting loosening of the piloted nut thus positively securing and centering the housing in the panel opening.

BRIEF DESCRIPTION OF THE DRAWINGS

Other features and advantages of the invention, such as reduced number of parts and improved service disassembly, will be evident from the following detailed description of the preferred embodiment of the invention and the accompanying drawings wherein:

FIG. 4 is a fragmentary forward end elevational view of the vehicle door handle mounting arrangement of FIG. 2 showing the arrangement assembled;

FIG. 5 a fragmentary aft end elevational view of the vehicle door handle mounting arrangement of FIG. 2 showing the arrangement assembled;

FIG. 6 is fragmentary top elevational view of the vehicle door handle mounting arrangement of FIG. 2 showing the arrangement assembled;

FIG. 7 is a fragmentary horizontal sectional view taken substantially on the line 7—7 of FIG. 3;

FIG. 8 is a fragmentary vertical sectional view taken substantially on the line 8—8 of FIG. 3 showing the spring rod retainer and housing initially installed on the door panel;

FIG. 9 is a view similar to FIG. 8 showing the spring rod retainer and housing fully installed assembled on the door panel;

FIG. 10 is a fragmentary vertical sectional view taken substantially on the line 10—10 of FIG. 3;

FIG. 11 is a top elevational detail view of the spring rod retainer of the present invention;

FIG. 12 is a side elevational detail view of the spring rod retainer of FIG. 11;

FIG. 13 is an end elevational detail view of the rod spring retainer of FIG. 11; and FIG. 14 is a fragmentary vertical sectional view of the lip flange portion of FIG. 10 showing the inclusion of a rubber gasket seal.

DETAILED DESCRIPTION OF THE PREFERRED EMBODIMENT

Figure 1:
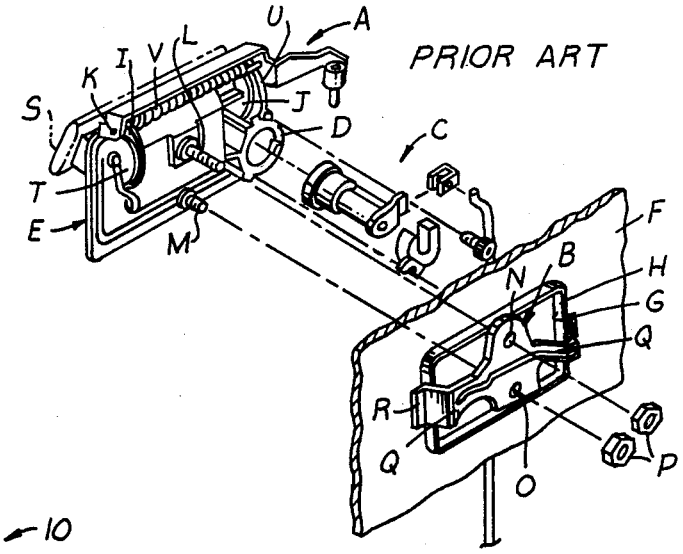
FIG. 1 is a fragmentary exploded perspective view of a prior art vehicle right-hand door handle mounting arrangement.
Figure 2:
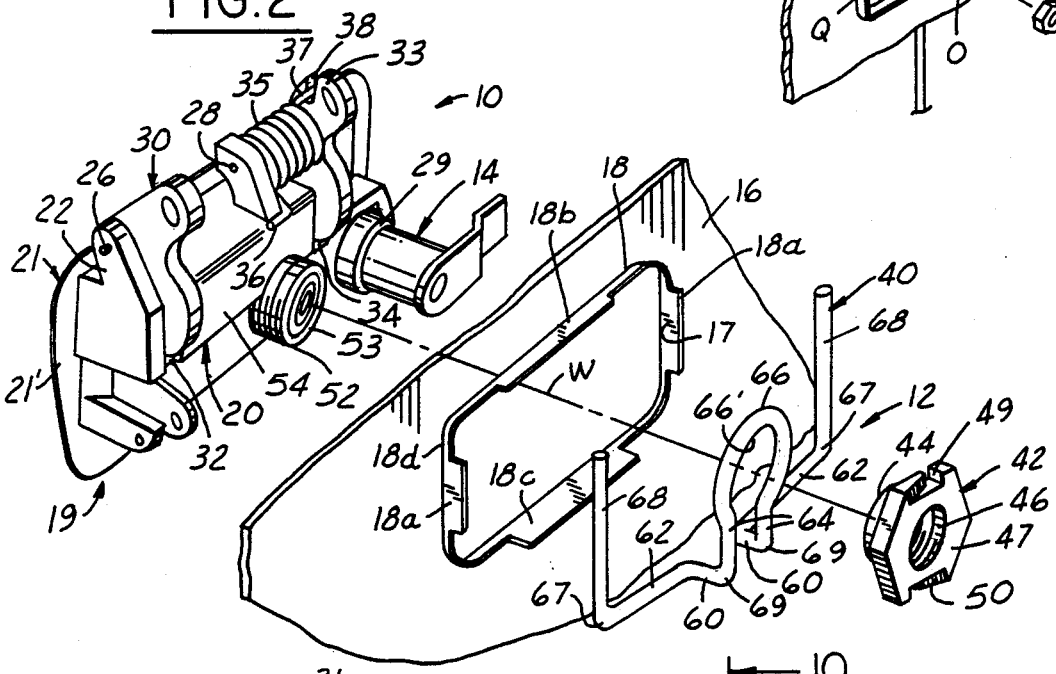
FIG. 2 is a fragmentary exploded perspective view of an improved vehicle right-hand door handle mounting arrangement of the present invention.

Referring now to FIG. 2 of the drawings there is shown an exploded perspective view of a vehicle outside door handle mounting arrangement in accordance with the present invention. The door handle mounting arrangement comprises a flush-type door handle assembly 10 adapted to be secured by a two piece retainer sub-assembly 12. A lock cylinder sub-assembly, partially indicated at 14, is shown for the purposes of completeness but forms no part of the present invention.

Figure 3:
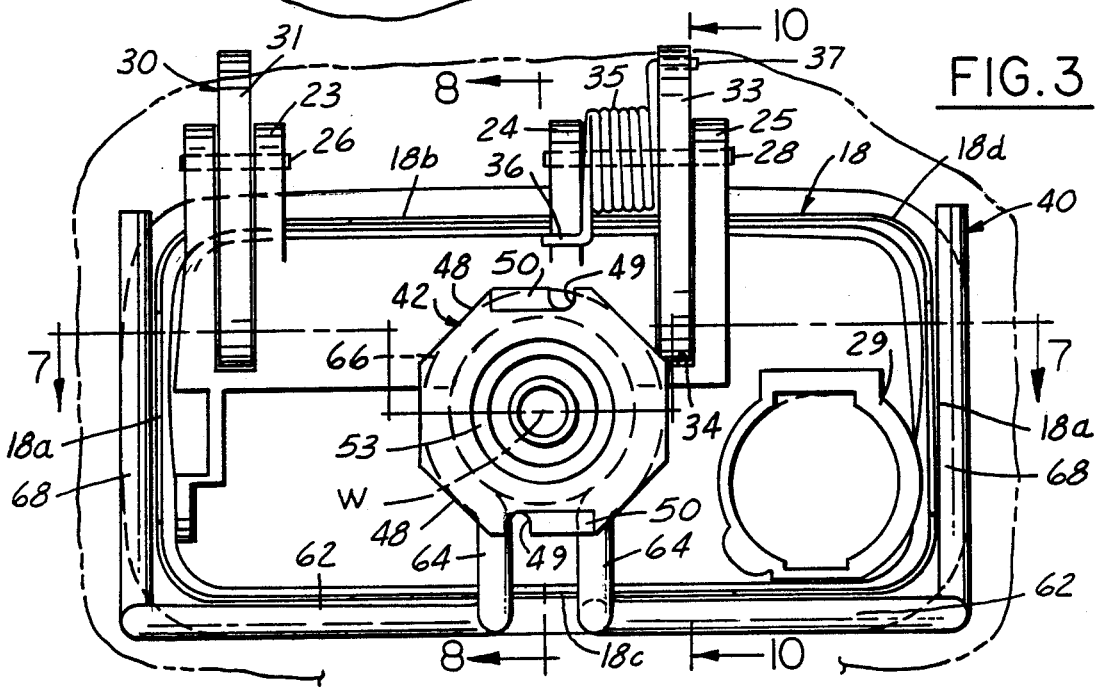
FIG. 3 is a fragmentary side elevational view of the vehicle door handle mounting arrangement of FIG. 2 showing the arrangement assembled.

A vehicle door outer panel 16 is shown formed with a rectangular-shaped opening 17 defined by an inwardly directed right-angled stiffening flange 18 extending continuously around its border. The panel opening 17 is adapted to initially receive the handle assembly 10 from the outside of the panel in a rock-in manner described below. It will be noted that the panel stiffening flange includes inwardly extended side portions **18*a*—18*a*, an upper portion 18*b*, and a lower portion 18*c* interconnected by narrower arcuate corner portions 18*d* configured to accommodate the particular handle assembly 10. As best seen in FIG. 3 the handle assembly 10 includes a housing member 19 having a main depressed body portion 20 defining an outwardly opening handle recess and an integral terminal lip flange portion 21 extending totally around the periphery of the main body portion overlying the panel around the opening 17. The housing member 19 is preferably molded from of polymeric or plastic material, with the main housing body portion 20 integrally formed with a first or forward pair of upwardly extending crank arms 22, 23 and a second or intermediate pair of upwardly extending crank arms 24, 25. The first pair of crank arms 22 and 23, spaced in a relatively close parallel manner, are positioned adjacent the forward end of the housing 20. The second pair of crank arms 24 and 25, positioned at a relatively increased spacing, are positioned slightly aft of the transverse medial plane that includes the vertical section line 8—8 in FIG. 3. The first pair of crank arms 22, 23 support a first or forward pivot pin 26 therebetween aligned on a common longitudinally extending pivotal axis with a second pivot pin 28 supported between the aft crank arms 24, 25**.

It will be noted in FIG. 2 that an integral cylindrical shaped hollow socket portion 29 is formed adjacent the aft end of the housing 19 for the reception of lock cylinder. In outside handle mounting arrangements for selected vehicle doors, such as the rear doors of a four-door model, require no lock cylinders enabling the socket portion 29 to be omitted. In such cases the crank arms 24 and 25 and lever arm slot 34 are located adjacent the aft end of the housing in a manner similar to the forward crank arms 22 and 23.

With reference to FIGS. 2, 4 and 5 a "pull-to" flush-type handle 30 is shown normally pivotally received in the main housing portion recess. The handle 30 is shown by dashed lines in FIG. 4 pivoted to its outwardly rotated operated position. The handle 30 is integrally formed with a first or forward lever arm 31 shown in FIG. 7 projecting through slot 32 in the main housing portion 20. Similarly a second or intermediate lever arm 33 projects through slot 34 in the main housing portion 20. The first lever arm 31 is pivotally supported on pivot pin 26 extending between the forward crank arms 22, 23 while the second lever arm 33 is pivotally supported on pivot pin 28 extending between the intermediate crank arms 24, 25.

The handle 30 is rotated about the pins 26 and 28 in a clockwise direction, as viewed in FIG. 4, from its gripping solid line position in the housing recess to its operated dashed line position against the biasing force of a helical spring 35 coiled around the aft pivot pin 28 to actuate the door latch mechanism (not shown) enabling the door to be opened. FIG. 2 shows the spring 35 having one end 36 hooked on the crank arm 24 and its other end 37 hooked to slot 38 in the intermediate lever arm 33 biasing the gripping portion of the handle toward its inoperative flush position. It will be noted in FIGS. 5 and 10 that the spring 35 is in pressure contact with the pin 28 so as to transfer its reaction force thereto.

As viewed in FIG. 2, the handle retaining subassembly 12 comprises a continuous bent spring rod retainer, generally indicated at 40, and a single attaching piloted nut 42. The piloted nut 42 comprises a smooth externally unthreaded cylindrical lead-in pilot collar portion 44, formed with a central internally threaded bore 46, and a driving hex head portion 47. The nut hex head portion 47, which extends radially outwardly from the collar portion 44, is defined by six hex faces 48 adapted for engagement by a suitable tool. Further, the head portion 47, as shown in FIGS. 2 and 3, formed with a pair of diametrically opposed notches 49 together with mirror image lead-in tangentially extending ramps 50 adapted to be engaged by an installation tool (not shown).

As seen in FIGS. 5, 6 and 7 the nut head portion 47 has a substantially flat undersurface 51 with the collar portion 44 extending axially from the head undersurface 51 a predetermined distance. In the disclosed embodiment FIG. 9 shows the collar 44 having an axial dimension slightly less than the diameter of the spring rod retainer eye formation to be described. The pilot collar axial dimension is chosen less than the diameter of the spring rod retainer enabling a suitable compression to be developed in the retainer 40 to induce a substantial locking preload on the nut undersurface and the panel inner surface. The nut internal thread 46 is adapted to engage an external thread 52 formed on the free end of cylindrical-shaped hub 53. The hub extends axially inboard from inboard facing surface 54 of the housing main body portion 20 and is preferably formed integral therewith.

With reference to FIGS. 2 and 11–13, the spring rod retainer 40 is transversely symmetrical from side to side about a vertical plane which includes the section line 8—8 of FIG. 3. The retainer 40 comprises, in its free state, a pair of mirror image L-shaped or angled rod-length base portions lying in a horizontally disposed base plane. The L-shaped base portions each comprise integrally-connected short 60—60 and long 62—62 legs disposed at a predetermined obtuse angle "X1" as seen in FIG. 11. In the disclosed embodiment the angle "X1" is an obtuse angle of the order of ninety-five degrees. As a consequence the long legs 62—62 are disposed at an acute angle "X2" which is of the order of five degrees from the vertical plane that includes the panel 16.

The short legs 60—60 extend inboard away from the panel 16 in adjacent parallel relation with one outboard end joined to the proximate end of an associated long leg 62—62. As seen in FIG. 13 the inboard ends of the short legs 60—60 are connected at a predetermined first obtuse angle "X3" to upstanding adjacent parallel transition or finger portions 64—64. In the disclosed embodiment the angle "X3" is of the order of ninety-five degrees. Each finger portion 64 upper end is connected to one open end 65 of a central open looped eye formation 66 defining a C-shaped, semi-circular opening or eyelet 66'. It will be noted in FIG. 13 that the finger portions 64—64 and the eye formation 66 lie in a common first inboard plane angled inboard from the base plane of the L-shaped portions at the obtuse angle "X3". As seen in FIG. 12 the distal end of each long leg 62—62 is connected by a right-angle or ninety degree bend 67 to one lower end of an upright rod arm portion 68. FIGS. 8 and 13 shows the rod arm portions 68—68 lying in a common second outboard plane oriented at an obtuse angle "X4" from the base plane. In the disclosed embodiment the obtuse angles "X3" and "X4" are of the order of ninety-five degrees.

It will be noted in FIG. 13 that the plane of the finger portions 64—64 and the central eye formation 66 is angled inboard at an acute angle "X5" from the vertical while the plane of the rod arm portions 68—68 is angled outboard at an acute angle "X6" from the vertical. In the disclosed embodiment the acute angles "X5" and "X6" are of the order of five degrees. It will be appreciated that the outboard plane of the arm portions 68—68 and the inboard plane of the eye formation 66 could, of course, be substantially vertical without departing from the scope of the invention.

As seen in FIG. 8 with the spring rod retainer 40 initially installed each upright arm portion 68 is in coextensive contact with the opposed side surface of its associated side flange portion **18*a*. In a similar manner with the spring rod retainer 40 properly assembled each angled leg portion 62 is located in juxtaposition with the underside of the lower flange portion 18*c*. It will be noted in FIG. 3 that with the spring rod retainer 40 properly located by the side flange portions 18*a* and bottom flange portion 18*c* the center of the retainer semi-circular eyelet 66' is self-aligned on symmetrical axis "W" of the rectangular opening 17. FIGS. 2 and 3 show the symmetrical axis "W", which includes the geometric center of the rectangular opening 17, is coaxial with the principal axis of the housing main body hub portion 53 upon the housing member 19 being inserted in the opening 17**.

During automotive assembly the housing member 19 is inserted by the assembler in the panel rectangular opening 17 from the outside in a rock-in manner. The housing member 19 is sized such that it self-centers itself in the opening 17 with the lip flange portion 21 in flush relation to the panel outer surface such that the hub principal axis is aligned with the geometric center of the rectangular opening 17. Next the spring rod retainer 40 is initially installed by the assembler with its upright rod arm portions 68—68 juxtaposed on their associated outwardly facing surface of side border flange **18*a* and the angled rod length portions 62—62, juxtaposed on the downwardly facing surface of border bottom flange 18*c* as seen in FIG. 3. The nut pilot collar 44 is then inserted in the retainer eyelet 66' and manually threaded on the housing hub portion external thread 53 whereby the retainer 40, in its free or unrestricted state (FIG. 8), is captured intermediate the axially spaced nut head portion undersurface 51 and the panel inner surface. Thereafter a spanner type tool is used to tighten the nut 42 to an established preload torque whereby the eye formation 66 is deflected to its substantially vertical position shown in FIG. 9. This preload on the undersurface 51** enables the nut to resist subsequent movement in an unscrewing or loosening direction.

It will be noted in FIGS. 6 and 7 that the upright rod arm portions 68 are substantially coextensive with and in axially facing opposed relation to associated side portions 21' of the terminal lip flange portion 21. Tightening down of the nut 42 causes pressure to be brought to bear on the spring rod retainer 40 resulting in the rod arm portions 68 being flexed into substantially flush engagement with the outer panel inboard surface. As a result the peripheral lip flange portion 21 is drawn to the panel outer surface such that sealing pressure is uniformly distributed to the sandwiched portion of the panel 16. Further, the uniform distribution of pressure on the panel by the retainer arm portions 68 and long leg portions 62 insures against bulges or dimples developing in the outer panel 16.

While there is described above the principles of this invention in connection with a specific embodiment, it is to be clearly understood that this description is made only by way of example and not as a limitation to the scope of this invention.

What is claimed is:

1. In a housing mounted on a vehicle body panel, said housing comprising a main portion extending inboard through a rectangular-shaped panel opening and having a terminal lip flange portion extending around the periphery of said housing main portion in flush engagement with the outboard surface of said panel, the panel opening symmetrical axis extending transversely through the geometric center thereof, said panel opening formed with inboard extending border side and bottom flange means, an improved arrangement for securing said housing in said panel opening comprising:

said housing main portion formed with an inboard extending cylindrical-shaped externally threaded hub having its principal axis substantially aligned on said opening symmetrical axis;

a piloted nut comprising a driving head portion and an internally threaded pilot collar portion extending from one undersurface of said head portion, said collar portion extending axially from said undersurface with its internal threads engaging said hub external thread;

a bent spring rod retainer interposed between the inboard surface of said panel and said nut driving head undersurface, said spring rod retainer in its free state comprising an inboard upstanding central open eye formation defining a semi-circular eyelet and a pair of outboard upstanding arm portions;

said bent spring rod retainer having a pair of angled rod-length portions lying in a horizontally disposed base plane, a pair of upstanding transition portions, each said transition portion joining an associated one end of said open eye formation with a respective inboard end of an associated angled rod-length base portion, and each said upstanding arm portion joined to the outboard end of an associated angled rod-length base portion;

each said spring retainer arm portion juxtaposed on the outwardly facing surface of an associated one of said border side flange means and each said angled rod-length base portion juxtaposed on the downwardly facing surface of said border bottom flange means, such that the center of said retainer eyelet is self-aligned on said panel rectangular opening symmetrical axis;

said eye formation semi-circular eyelet having a predetermined diameter slightly greater than said piloted nut collar for passage of said collar within said eyelet with no play upon said collar internal thread being threaded-on said hub external thread; and whereby upon said nut being turned in a threading-on direction pressure is brought to bear on said open eye formation and said arm portions causing said spring retainer to be axially flexed wherein said retainer provides a constant spring biasing preload acting on said nut driving head undersurface and said panel inboard surface locking said nut against loosening while said arrangement secures said housing in said panel opening.

2. The housing securing arrangement as set forth in claim 1, wherein said spring retainer eye formation in said free state lying in a first imaginary plane angled inboard from said base plane at a predetermined first obtuse angle.

3. The housing securing arrangement as set forth in claim 1, wherein said spring retainer upstanding arm portions in said free state lying in a second imaginary plane angled outboard from said base plane at a predetermined second obtuse angle.

4. The housing securing arrangement as set forth in claim 1, wherein said pair of angled rod-length portions in the form of a pair of mirror image L-shaped base portions, each said L-shaped base portion comprising integrally-connected short and long legs, each said short leg extending inboard from the proximate end of its associated long leg, the inboard end of each said short leg joined to one lower end of an associated one of said upstanding transition portions, and each said long leg distal end joined by a substantially right-angle bend to an associated one of said arm portions.

5. The housing securing arrangement as set forth in claim 1, wherein said spring rod retainer has a predetermined diameter greater than the axial length of said nut collar portion.

6. The housing securing arrangement as set forth in claim 1, wherein said upstanding arm portions having a predetermined height slightly greater than the height of said panel rectangular-shaped opening.

7. The housing securing arrangement as set forth in claim 4, wherein in the free state of said spring retainer each said connected short and long leg disposed at a predetermined obtuse angle of the order of ninety-five degrees such that each said long leg being oriented at an acute angle of the order of five degrees from the imaginary plane that includes said panel.

8. In a door handle housing mounted on a vehicle body panel, said housing comprising a main portion extending inboard through a rectangular-shaped panel opening and a lip portion extending around the periphery of said main portion in flush engagement with the outboard surface of said panel, the panel opening symmetrical axis extending transversely through the geometric center thereof, the panel opening formed with opposed inwardly extending border side and bottom flange portions, an improved arrangement for securing said housing in said panel opening comprising:

said housing main portion formed with an inwardly extending cylindrical-shaped externally threaded hub having its principal axis substantially aligned on said symmetrical axis, a piloted nut having an internally threaded collar engaging said hub portion external thread, said nut having a radially extending driving head portion forming a substantially flat outboard facing undersurface;

a bent spring rod retainer being transversely symmetrical from side to side clamped between the inboard surface of said panel and said nut driving head undersurface, said spring retainer in its free state comprising an inboard upstanding central eye formation disposed in a first inboard plane and a pair of upstanding arm portions disposed in a second outboard plane;

said bent spring rod retainer formed with a pair of mirror image generally L-shaped base portions lying in a horizontally disposed base plane, said L-shaped base portions each comprising integrally-connected short and long legs, said short legs extending inboard in adjacent parallel relation from the proximate ends of one of said associated long legs, the inboard ends of said short legs joined to upstanding adjacent parallel transition portions, each transition portion having its upper end connected to an associated one end of said open eye formation, whereby said transition portions and said eye formation lying in said first inboard plane, said first inboard plane angled inboard from said base plane at a first obtuse angle, each said long leg distal end connected by a right-angle bend to an associated one of said rod arm portions, said rod arm portions having a predetermined height slightly greater than the height of said panel opening;

each said rod arm portion juxtaposed on the outwardly facing surface of an associated one said border side flanges and each said L-shaped base portion long leg juxtaposed on the downwardly facing surface of said border bottom flange whereby the center of said retainer eyelet is aligned on said panel opening symmetrical axis; and said eye formation semi-circular eyelet having a predetermined diameter slightly greater than said piloted nut collar for passage of said collar within said eyelet with no play upon said collar internal thread engaging said hub external thread;

whereby upon said nut being turned in a threading-on direction pressure is brought to bear on said eye formation and said pair of arm portions causing said spring retainer to be axially flexed wherein said retainer provides a constant spring biasing preload acting on said nut driving head undersurface and said panel inboard surface locking said nut against loosening while said arrangement secures said housing in said panel opening.

* * * * *